US011033919B2

(12) United States Patent
Hom et al.

(10) Patent No.: US 11,033,919 B2
(45) Date of Patent: Jun. 15, 2021

(54) DISPENSER

(71) Applicant: Colgate-Palmolive Company, New York, NY (US)

(72) Inventors: Frank Hom, Wayne, NJ (US); John Crawford, Mahopac, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/464,713

(22) PCT Filed: Dec. 1, 2016

(86) PCT No.: PCT/US2016/064434
§ 371 (c)(1),
(2) Date: May 29, 2019

(87) PCT Pub. No.: WO2018/101949
PCT Pub. Date: Jun. 7, 2018

(65) Prior Publication Data

US 2019/0308209 A1 Oct. 10, 2019

(51) Int. Cl.
*B05B 11/00* (2006.01)

(52) U.S. Cl.
CPC ..... *B05B 11/0086* (2013.01); *B05B 11/0081* (2013.01)

(58) Field of Classification Search
CPC ..... B05B 11/0081; B05B 11/0086
See application file for complete search history.

(56) References Cited

U.S. PATENT DOCUMENTS

| | | | |
|---|---|---|---|
| 5,944,233 | A | 8/1999 | Bourne |
| 6,155,459 | A | 12/2000 | Bunschoten |
| 7,926,682 | B2 | 4/2011 | Nelson et al. |
| 8,152,025 | B2 | 4/2012 | Foster |
| 10,744,523 | B2 * | 8/2020 | Vellutato, Jr. ..... A61L 2/22 |

(Continued)

FOREIGN PATENT DOCUMENTS

| | | |
|---|---|---|
| CN | 104936707 | 9/2015 |
| CN | 104955583 | 9/2015 |
| CN | 205023832 | 2/2016 |

OTHER PUBLICATIONS

International Search Report and Written Opinion of the International Searching Authority in International Application No. PCT/US2016/064434, dated Aug. 2, 2017.

*Primary Examiner* — J C Jacyna

(57) ABSTRACT

A dispenser includes a housing that defines a first opening and a second opening. The first opening provides a first path of fluid communication between a first interior volume of the housing and an exterior of the housing. The second opening provides a second path of fluid communication between a second interior volume of the housing and the exterior of the housing. A divider is positioned in the housing between the first interior volume and the second interior volume. The divider defines a third opening that provides a third path of fluid communication between the first interior volume and the second interior volume. A valve allows fluid to flow from the second interior volume, through the third opening, and into the first interior volume and prevents the fluid from flowing from the first interior volume, through the third opening, and into the second interior volume.

13 Claims, 7 Drawing Sheets

(56) References Cited

U.S. PATENT DOCUMENTS

| | | | | |
|---|---|---|---|---|
| 2004/0238566 | A1* | 12/2004 | Stank | B65D 81/3222 222/130 |
| 2008/0073375 | A1* | 3/2008 | Nelson | B01F 15/0205 222/129 |
| 2011/0031271 | A1* | 2/2011 | Foster | B05B 11/0056 222/1 |
| 2013/0037569 | A1 | 2/2013 | Schmidt | |
| 2014/0183225 | A1* | 7/2014 | Wales | B65D 81/3211 222/129 |
| 2014/0319245 | A1 | 10/2014 | Schmidt | |
| 2015/0223632 | A1* | 8/2015 | Hall | B65D 85/804 99/295 |

* cited by examiner

DISPENSER

BACKGROUND

A home care cleaning solution is typically sold in a dispenser that includes a housing and a pump assembly. A pre-mixed cleaning solution is disposed within the housing. When a user actuates the pump assembly, the cleaning solution flows (e.g., sprays) out through a nozzle in the pump assembly.

In some previous dispensers, the user may pour a measured amount of concentrated cleaning solution into the housing through a first end of the housing, and pour a measured amount of water into the housing through a second end of the housing. The concentrated cleaning solution and water mix together in the housing. After mixing occurs, a user may actuate the pump assembly, causing the mixture to flow out through the nozzle in the pump assembly. When all of the mixture in the housing is exhausted, the user may pour additional measured amounts of concentrated cleaning solution and/or water into the housing to create a new mixture, so that the dispenser may continue to be used with the new mixture.

There is sometimes a need for the user to clean with multiple cleaning solutions having varying degrees of concentration. To accomplish this currently, the user has a first dispenser having a cleaning solution with a first concentration, and a second dispenser having a cleaning solution with a second concentration. What is needed, however, is an improved dispenser for dispensing multiple cleaning solutions having varying degrees of concentration

BRIEF SUMMARY

A dispenser is disclosed. The dispenser includes a housing that defines a first opening and a second opening. The first opening provides a first path of fluid communication between a first interior volume of the housing and an exterior of the housing. The second opening provides a second path of fluid communication between a second interior volume of the housing and the exterior of the housing. A divider is positioned in the housing between the first interior volume and the second interior volume. The divider defines a third opening that provides a third path of fluid communication between the first interior volume and the second interior volume. A valve allows fluid to flow from the second interior volume, through the third opening, and into the first interior volume and prevents the fluid from flowing from the first interior volume, through the third opening, and into the second interior volume.

In another embodiment, the dispenser includes a housing defining a first interior volume and a second interior volume. A first opening provides a first path of fluid communication between the first interior volume and an exterior of the housing. A divider is positioned in the housing between the first interior volume and the second interior volume. The divider defines a second opening that provides a second path of fluid communication between the first interior volume and the second interior volume. A valve allows fluid to flow from the second interior volume, through the second opening, and into the first interior volume and prevents the fluid from flowing from the first interior volume, through the second opening, and into the second interior volume. A first visual indicator is positioned on a portion of the housing that is substantially transparent and defines the first interior volume.

A method for using a dispenser is also disclosed. The method includes introducing a first liquid into a first interior volume of a housing of the dispenser. The method also includes transferring a first portion of a second liquid from a second interior volume of the housing into the first interior volume to form a mixture. The method further includes dispensing at least a portion of the mixture from the first interior volume through a first opening in the housing to an exterior of the housing. The housing is configured to dispense a second portion of the second liquid from the second interior volume of the housing through a second opening in the housing to the exterior of the housing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawing, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
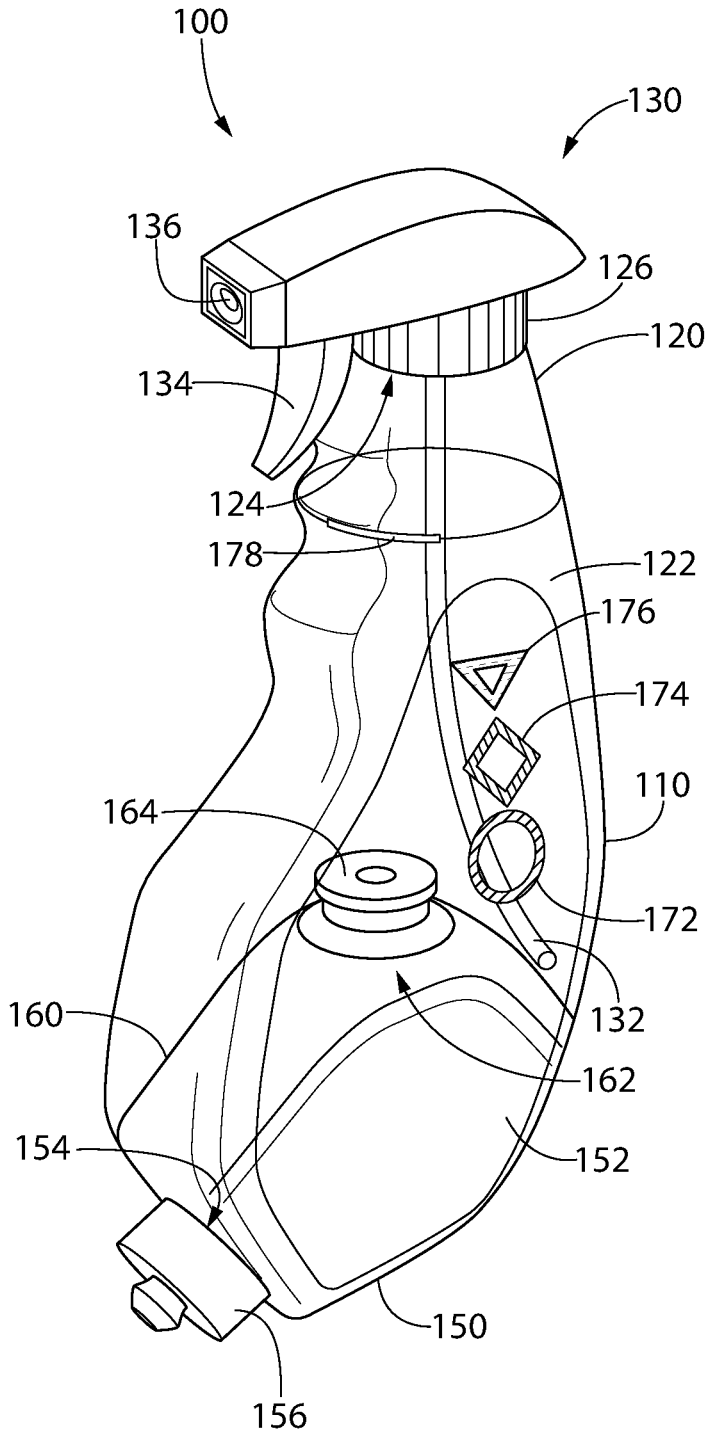
FIG. 1 depicts a perspective view of an example of a dispenser, according to an embodiment.

FIG. 1 depicts a perspective view of an example of a dispenser 100, according to an embodiment. The dispenser 100 may include a housing (e.g., a bottle) 110. The housing 110 may include a first (e.g., upper) end 120 and a second (e.g., lower) end 150. The housing 110 may define a first interior volume 122 and a second interior volume 152. The housing 110 may define a first opening 124 that provides a path of fluid communication between the first interior volume 122 and an exterior of the housing 110. As shown, the first opening 124 may be positioned proximate to the upper end 120 of the housing 110. As described in more detail below, a first liquid may be introduced into the first interior volume 122 through the first opening 124. The first liquid may be or include water, alcohol, surfactant, or combinations thereof and the like.

A first cap 126 may be coupled to the housing 110 to cover the first opening 124. As shown, the first cap 126 may be part of a pump assembly 130 that also includes a tube 132, an actuator 134, and an outlet (e.g., a nozzle) 136. In another embodiment, the first cap 126 may not be part of a pump assembly 130. Rather, the first cap 126 may seal the first opening 124 when coupled to the housing 110 and be uncoupled from the housing 110 to allow fluid to flow through the first opening 124. In yet another embodiment, the first cap 126 may be actuated between a first position and a second position while the first cap 126 remains coupled to the housing 110. The first position may seal the first opening 124, and the second position may allow fluid to flow through the first opening 124.

The housing 110 may also define a second opening 154 that places the second interior volume 152 in fluid communication with the exterior of the housing 110. The second opening 154 may be positioned proximate the lower end 150 of the housing 110. As described in more detail below, a second liquid may be introduced into and/or dispensed from the second interior volume 152 through the second opening 154. The second liquid may be or include a concentrated cleaning solution such as a soap, a surface cleaner detergent, a degreaser, another household cleaner, or the like. For example, the concentrated cleaning solution may be or include Fabuloso® brand household cleaner produced by the Colgate-Palmolive Company. In other embodiments, the second liquid may be or include body wash, facial cleanser, hair care or styling products, skin moisturizers, cosmetic or therapeutic skin products, or the like. In at least one embodiment, the second liquid may be in the form of a gel.

A second cap 156 may be coupled to the housing 110 to cover the second opening 154. The second cap 156 may be the same type of cap as the first cap 126, or the second cap 156 may be different. As shown, the second cap 156 is different and may be a push-pull cap that is actuated between a first position and a second position while the second cap 156 remains coupled to the housing 110. The first position may seal the second opening 154, and the second position may allow fluid to flow through the second opening 154 from or into the second interior volume 152. In another example, the second cap 156 may be a flip-top cap.

In at least one embodiment, the first and second interior volumes 122, 152 may be separated by a divider 160. The housing 110 with the divider 160 separating the first and second interior volumes 122, 152 may be produced via blow-molding, injection molding, rotational molding, or the like. The divider 160 may include one or more divider openings (one is shown: 162, which is the third opening in this FIG.) that places the first and second interior volumes 122, 152 in fluid communication with one another. A one-way valve (e.g., a check valve) 164 may be positioned in the divider opening 162. The one-way valve 164 may allow the second liquid to flow from the second interior volume 152 into the first interior volume 122 while preventing any liquid from flowing from the first interior volume 122 into the second interior volume 152.

In another embodiment, the dispenser 100 may include a first housing (not shown) that defines the first interior volume 122 and a second housing (not shown) that defines the second interior volume 152. The first and second housings may be coupled together, and the portions of the first and second housings that border one another may form the divider 160. For example, the first housing may include the divider opening 162, and the second housing may include the one-way valve 164 and/or a nozzle, or vice versa. In such embodiments, the one-way valve 164 or a nozzle on the second housing may be inserted at least partially into/through the divider opening 162 and into the first interior volume 122 when the first and second housings are coupled together. The first and second housings may be coupled together via a screw thread, a bayonet-style twist lock, a press fit, a hinged latch, an elastomeric seal, or a combination thereof.

In at least one embodiment, one or more vent openings (not shown) may be formed in the pump assembly 130, the second cap 156, the divider 160, the check valve 164, or a combination thereof. The vent opening may allow air to flow into first interior volume 122 and/or the second interior volume 152 when the second liquid flows from the second interior volume 152, through the divider opening 162, and into the first interior volume 122. Thus, the vent opening may prevent a vacuum effect in the second interior volume 152.

As described in more detail below, the first and second liquids may be combined and mixed in the first interior volume 122 to form a mixture. In at least one embodiment, the first and second liquids may be different colors. For example, the first liquid may be essentially clear or colorless, and the second liquid may be blue. In this example, the mixture may be a shade of blue that is lighter than the shade of blue of the second liquid. At least a portion of the housing 110 that defines the first interior volume 122 may be substantially clear or transparent to allow the user to see the color of the mixture. The housing 110 may include one or more visual indicators (three are shown: 172, 174, 176) positioned on/over the substantially clear portion of the housing 110, which may help the user determine the concentration of the mixture in the first interior volume 122 based on the color or the volume of the mixture. For example, each visual indicator 172, 174, 176 may be a shade of a possible color of the mixture of the first and second liquids (e.g., a shade of blue) that corresponds to a known concentration of the mixture. In other words, the shade of color of each visual indicator 172, 174, 176 may correspond to a specific amount of the concentrated blue first liquid mixed and/or diluted into the essentially colorless second liquid within the first interior volume. For example, the first visual indicator 172, which may be in the shape of a circle, may be a relatively dark shade of blue that corresponds to a first known concentration of the liquid mixture. The second visual indicator 176, which may be in the shape of a rectangle or diamond, may be a lighter shade of blue corresponding to a second known, lesser concentration of the mixture. And the third visual indicator 176, which may be in the shape of a triangle, may be an even lighter shade of blue corresponding to another, more diluted concentration of the mixture.

The housing 110 may also include a fourth visual indicator 178 positioned on/over the substantially clear portion that may help the user determine how much of the first liquid to add to the first interior volume 122, as described in more detail below. This may aid the user in achieving the desired concentration.

Figure 2:
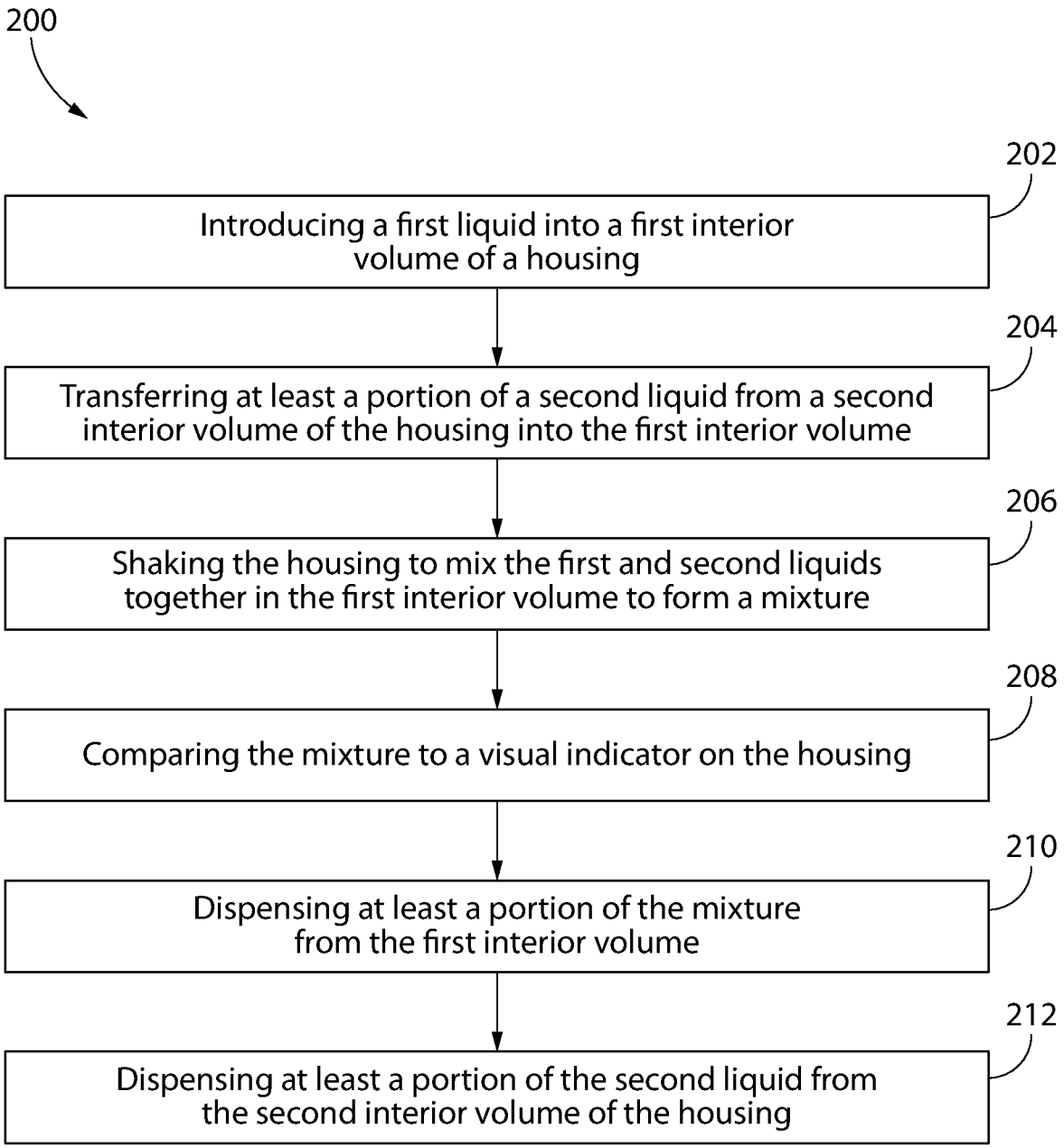
FIG. 2 illustrates a flowchart of an example of a method for filling up and using the dispenser, according to an embodiment.

FIG. 2 illustrates a flowchart of an example of a method 200 for filling up and using the dispenser 100, according to an embodiment. The method 200 may be referred to together with FIGS. 3-7, which illustrate examples of the various steps/stages of the method 200. The steps of the method 200 may be performed in the order described below or in any other order and some may be omitted in some implementations.

Figure 3:
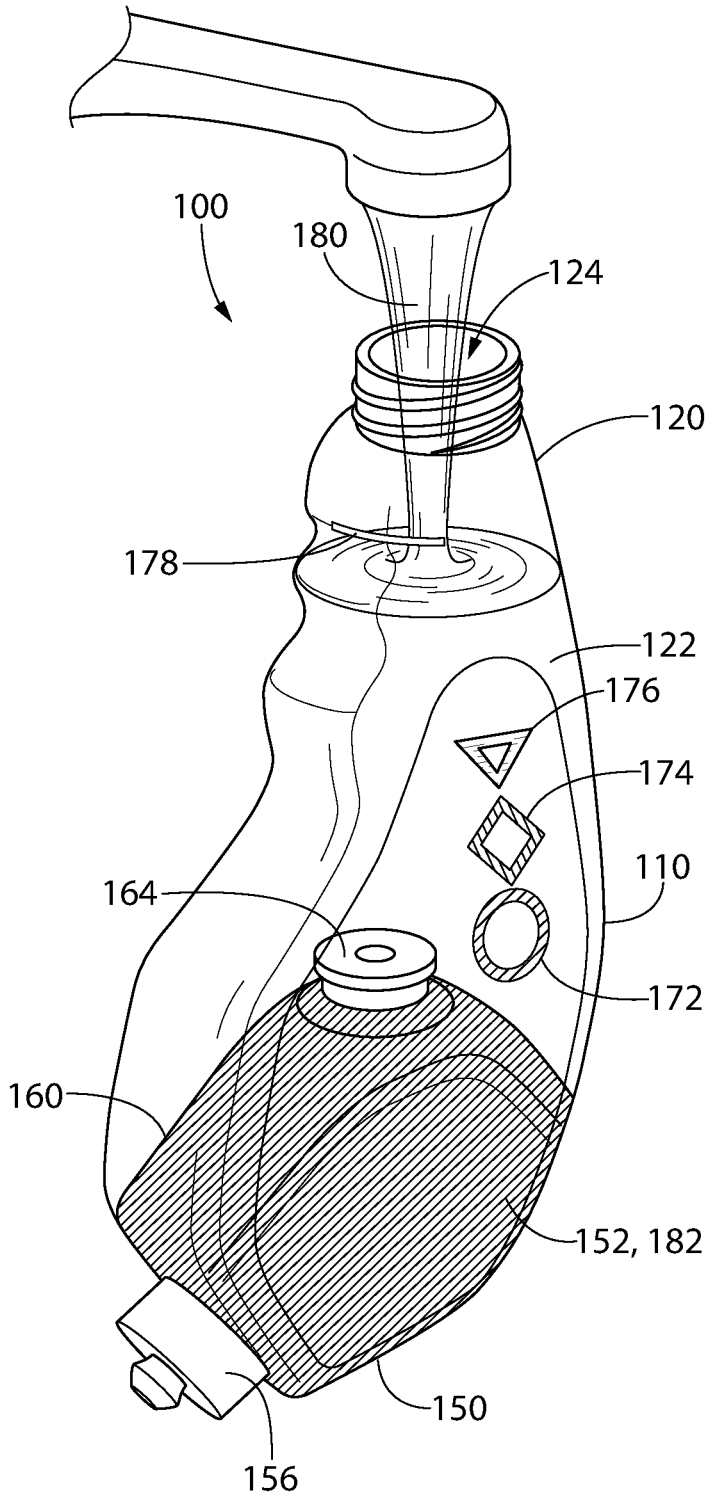
FIG. 3 illustrates water being introduced into a first interior volume of the dispenser, according to an embodiment.

The method 200 may include introducing the first liquid 180 into the first interior volume 122 of the housing 110, as at 202. This is illustrated in FIG. 3. Introducing the first liquid 180 may include uncoupling and removing the first cap 126 and subsequently introducing the first liquid into the first interior volume 122 of the housing 110 through the first opening 124. For example, the first liquid 180 may be introduced until it fills the first interior volume 122 to the fourth visual indicator 178. The first cap 126 may then be re-coupled to the housing 110.

Figure 4:
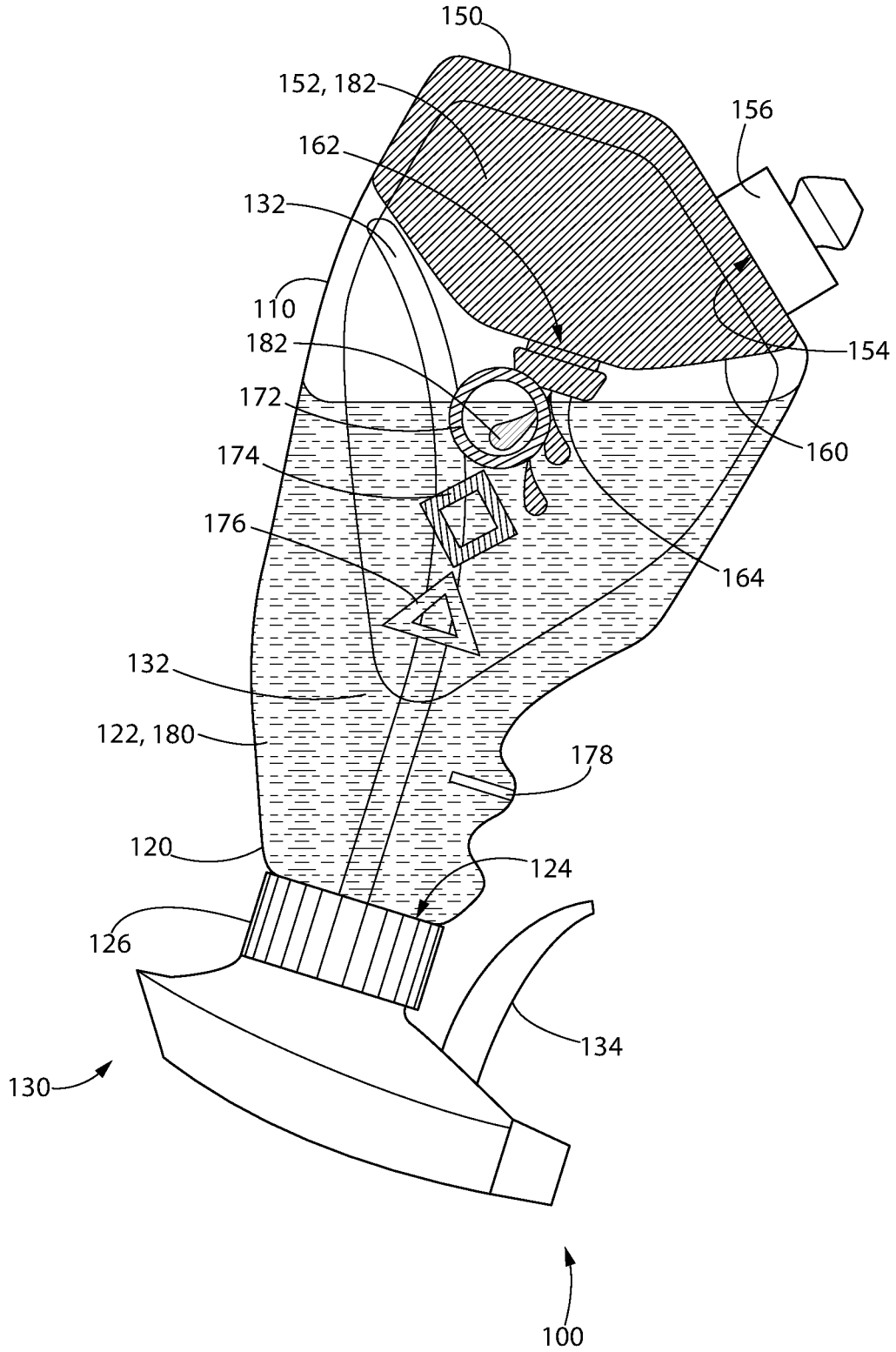
FIG. 4 illustrates a concentrated liquid being transferred from a second interior volume of the dispenser into the first interior volume, according to an embodiment.

The method 200 may also include transferring at least a portion of the second liquid 182 from the second interior volume 152 into the first interior volume 122, as at 204. This is illustrated in FIG. 4. Transferring at least a portion of the second liquid 182 may include squeezing the portion of the housing 110 around the second interior volume 152 to compress the second interior volume 152, for example when a user grasps the portion of the housing 110 around the second interior volume 152 using their hand and applies pressure with their thumb and fingers. Each squeeze may cause a known or approximately specific amount of the second liquid (e.g., approximately 5 milliliters) to be transferred from the second interior volume 152 into the first interior volume 122. This may help the user obtain the desired concentration of the resulting mixture in the first interior volume 122. Instead of, or in addition to, squeezing the housing 110, the user may invert the housing 110, as shown, to cause or assist in transferring of the second liquid 182 from the second interior volume 152 into the first interior volume 122. The first liquid 180 may be introduced into the first interior volume 122 of the housing 110 before or after the portion of the second liquid 182 is transferred from the second interior volume 152 into the first interior volume 122.

Figure 5:
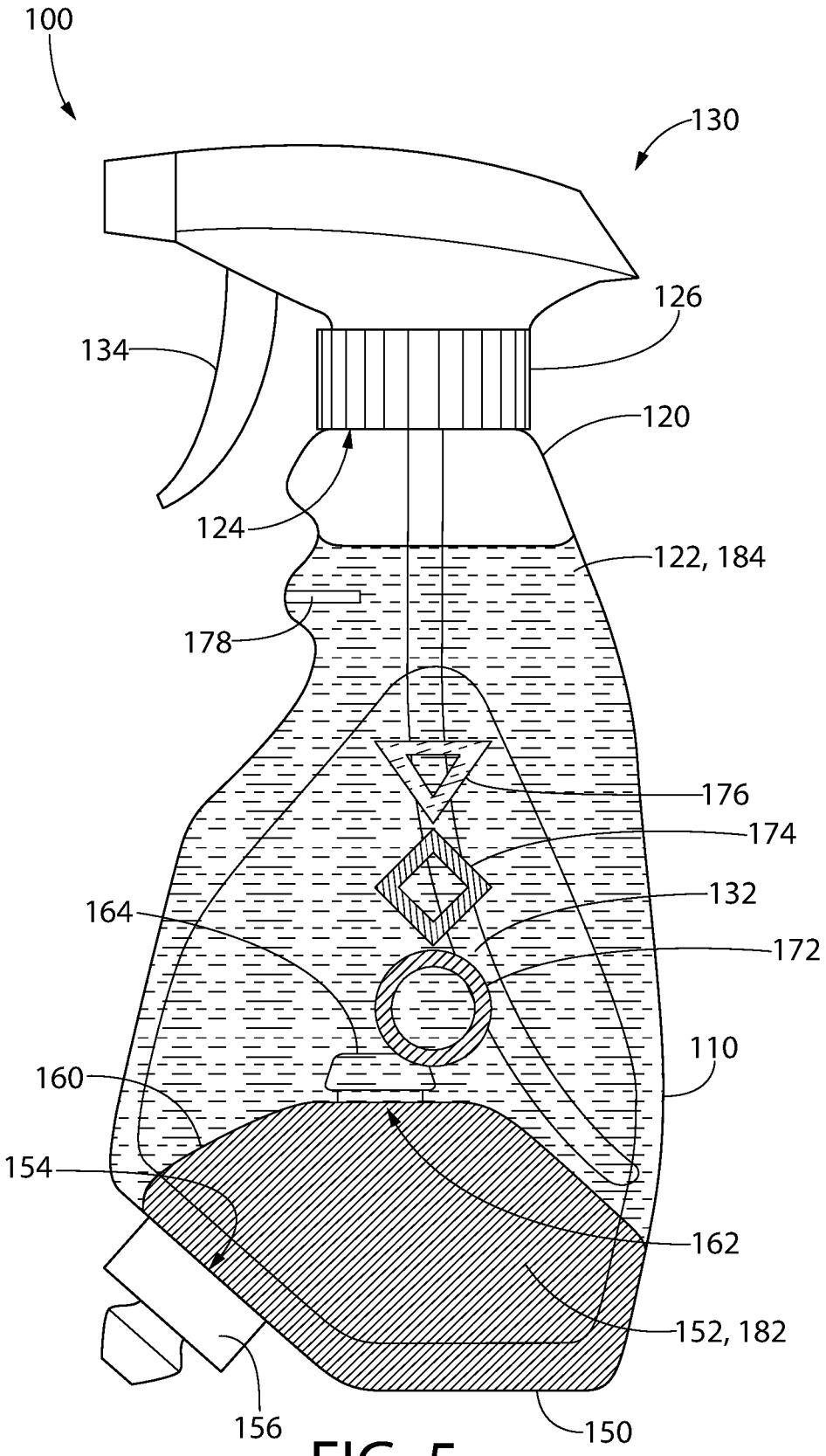
FIG. 5 illustrates the dispenser having the water and the concentrated liquid combined in the first interior volume forming a mixture therein, according to an embodiment.

The method 200 may also include shaking the housing 110 to mix the first and second liquids 180, 182 together in the first interior volume 122 to form the mixture 184, as at 206. This is shown in FIG. 5. The method 200 may also include comparing the mixture to the visual indicator(s) 172, 174, 176, as at 208. More particularly, the method 200 may include comparing a color of the mixture 184 to the color(s) of the visual indicator(s) 172, 174, 176. In an example where the color of the visual indicator 176 corresponds to the desired amount or concentration of the second liquid 182 in the mixture 184, then if the color of the mixture 184 is darker than the color of the visual indicator 176, then step 202 may be repeated to introduce additional first liquid 180 into the first interior volume 122 of the housing 110. If, on the other hand, the color of the mixture 184 is lighter than the color of the visual indicator 176, then step 204 may be repeated to transfer more of the second liquid 182 from the second interior volume 152 into the first interior volume 122.

Figure 6:
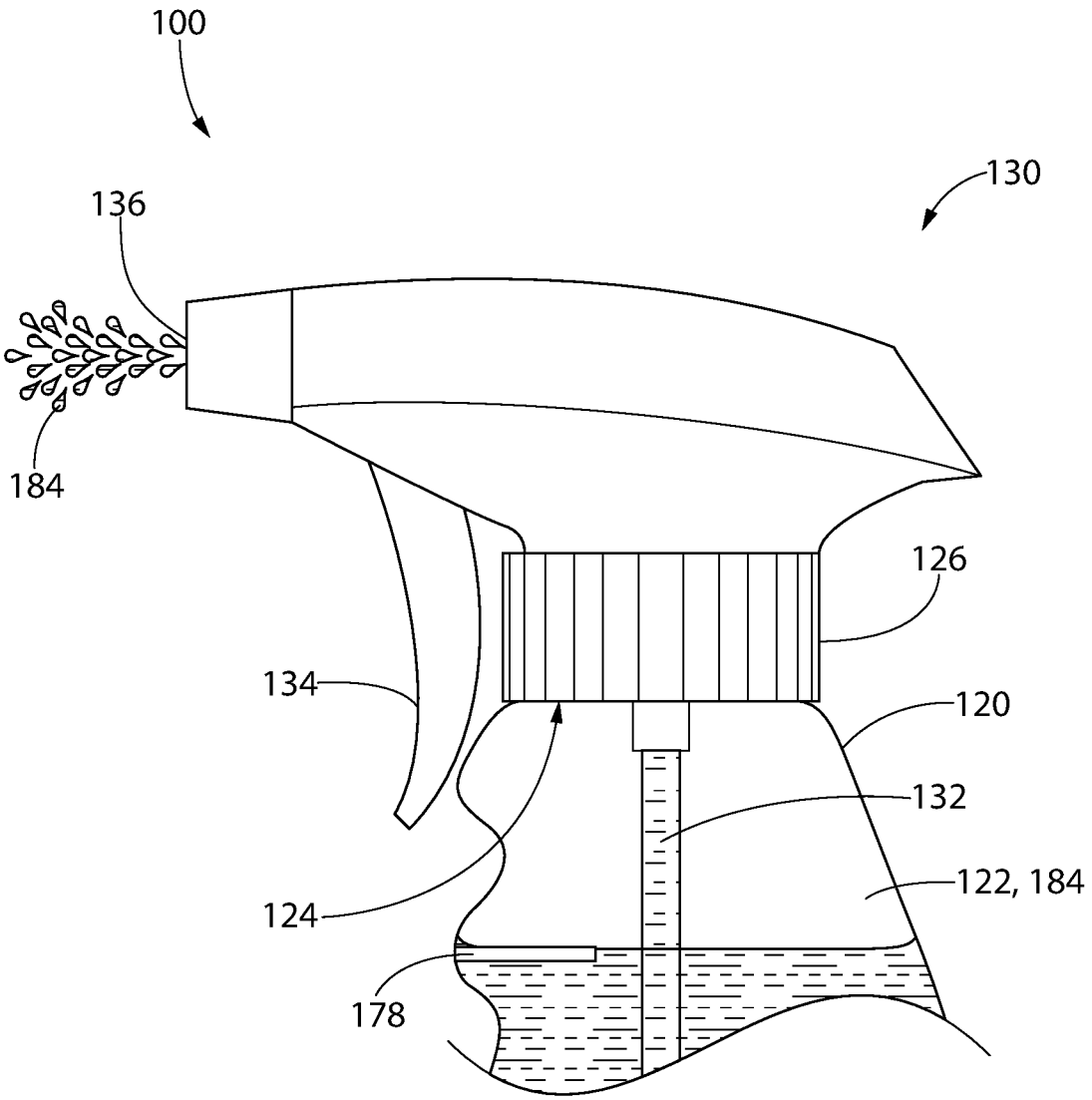
FIG. 6 illustrates the mixture being dispensed from the first interior volume, according to an embodiment.

The method 200 may also include dispensing at least a portion of the mixture 184 from the first interior volume 122 of the housing 110 through the first opening 124, as at 210. This is shown in FIG. 6. Dispensing at least a portion of the mixture 184 may include actuating the actuator 134 of the pump assembly 130. As shown, the actuator 134 is a trigger that may be actuated by a user squeezing the trigger. In another embodiment (not shown), an actuator may be actuated by pushing down on a portion of the pump assembly. In response to actuating the actuator 134, a portion of the mixture 184 may be pumped into and upward through the tube 132 and exit the pump assembly 130 via the outlet 136 (e.g., sprayed onto a surface to be cleaned). The mixture 184 may exit the pump assembly 130 as a spray or foam or the like.

Figure 7:
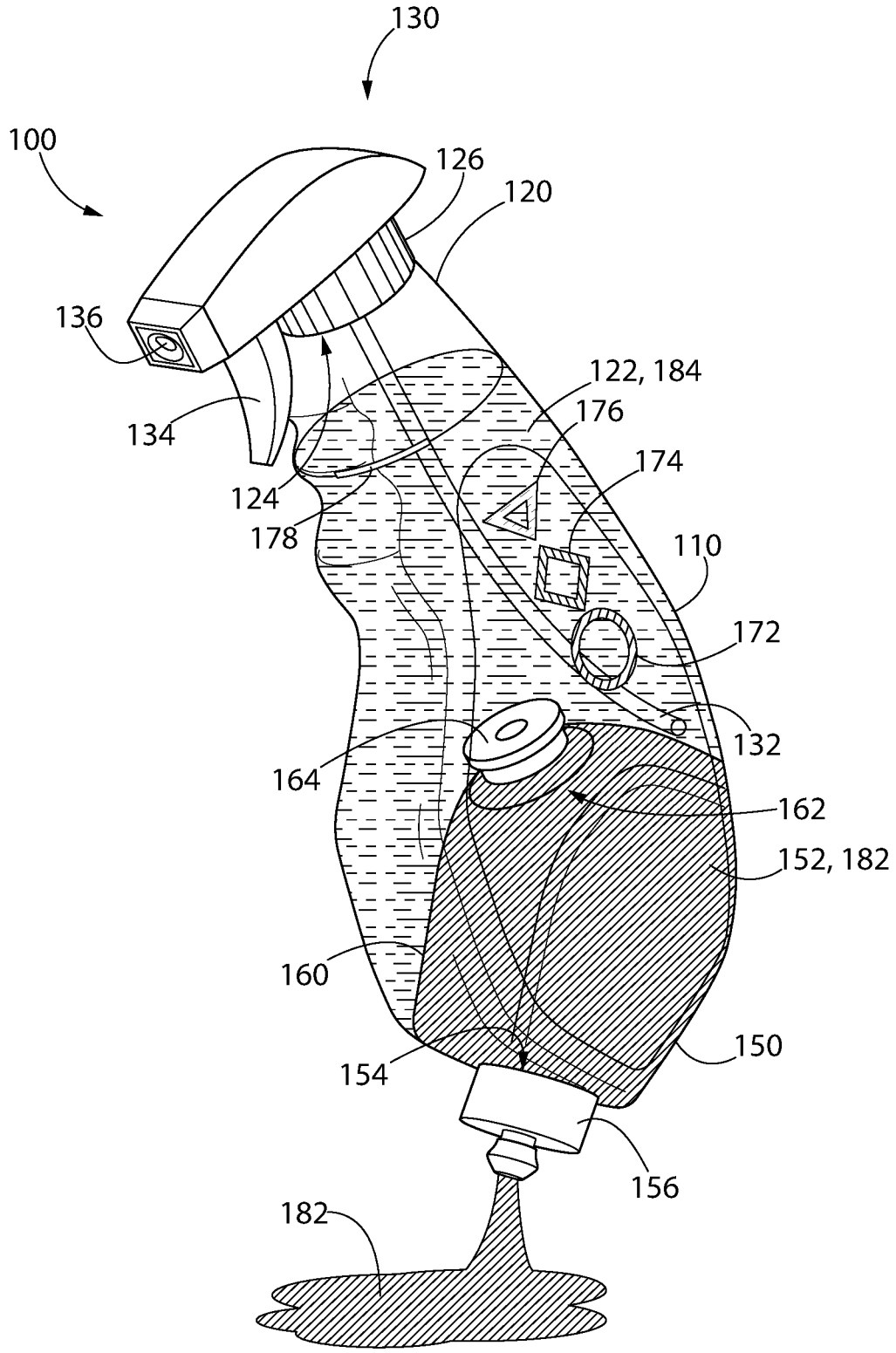
FIG. 7 illustrates the concentrated liquid being dispensed from the second interior volume, according to an embodiment.

The method 200 may also include dispensing at least a portion of the second liquid 182 from the second interior volume 152 of the housing 110 through the second opening 154 (e.g., poured or squirted onto a surface to be cleaned), as at 212. This is shown in FIG. 7. Dispensing at least a portion of the second liquid 182 may include removing the second cap 156 or actuating the second cap 156 from a first position to a second position. Dispensing at least a portion of the second liquid 182 may also include squeezing the portion of the housing 110 around the second interior volume 152 to compress the second interior volume 152 while the housing 110 is right-side up, as shown in FIG. 7, (i.e., not inverted). Each squeeze may cause a known or approximately specific amount of the second liquid (e.g., 10 milliliters) to be dispensed from the second interior volume 152 through the second opening 154 (e.g., onto the surface to be cleaned). The portion of the second liquid 182 may be dispensed from the second interior volume 152 of the housing 110 before or after either: the first liquid 180 is introduced into the first interior volume 122 of the housing 110 (i.e., step 202), the portion of the second liquid 182 is transferred from the second interior volume 152 into the first interior volume 122 (i.e., step 204), the housing 110 is shaken to mix the first and second liquids 180, 182 together in the first interior volume 122 to form the mixture 184 (i.e., step 206), the mixture is compared to the visual indicator(s) 172, 174, 176 (i.e., step 208), and/or the portion of the mixture 184 is dispensed from the first interior volume 122 of the housing 110 (i.e., step 210).

Thus, the dispenser 100 may allow a user to easily and efficiently dispense the second liquid 182 as part of a diluted mixture 184 (e.g., through the first opening 124) or in its fully concentrated form (e.g., through the second opening 154) as desired or needed for different cleaning tasks. In addition, the user may be able to easily and precisely select or create the desired concentration level of the mixture 184 without significant spillage, mess, or error.

What is claimed is:

1. A dispenser, comprising:

a housing defining:

a first opening that provides a first path of fluid communication between a first interior volume of the housing and an exterior of the housing; and a second opening that provides a second path of fluid communication between a second interior volume of the housing and the exterior of the housing;

a divider positioned in the housing between the first interior volume and the second interior volume, wherein the divider defines a third opening that provides a third path of fluid communication between the first interior volume and the second interior volume; and a valve that allows fluid to flow from the second interior volume, through the third opening, and into the first interior volume and prevents the fluid from flowing from the first interior volume, through the third opening, and into the second interior volume, a first cap coupled to the housing to cover the first opening; and a second cap coupled to the housing to cover the second opening, wherein the first cap actuates differently than the second cap.

2. The dispenser of claim 1, further comprising a first liquid disposed in the first interior volume and a second liquid disposed in the second interior volume, wherein the first liquid is different than the second liquid.

3. The dispenser of claim 2, wherein the first liquid comprises water, surfactant, or a combination thereof, and wherein the second liquid comprises a cleaning solution.

4. The dispenser of claim 3, further comprising a vent opening that prevents a vacuum effect from occurring in the second interior volume when a portion of the second liquid is transferred from the second interior volume, through the third opening, and into the first interior volume.

5. The dispenser of claim 3, wherein at least a portion of the housing is substantially transparent, and wherein the housing comprises a first visual indicator on the portion of the housing that is substantially transparent.

6. The dispenser of claim 5, wherein the first visual indicator is a lighter shade of a color of the second liquid.

7. The dispenser of claim 6, wherein the first visual indicator corresponds to a known concentration of the second liquid in a mixture of the first liquid and the second liquid in the first interior volume.

8. The dispenser of claim 6, wherein the housing comprises a second visual indicator on the portion of the housing that is a different shade of the color of the second liquid and corresponds to a different known concentration of the second liquid in the mixture.

9. The dispenser of claim 1, wherein the first cap is part of a pump assembly.

10. A method for using a dispenser, comprising:

introducing a first liquid into a first interior volume of a housing of the dispenser, the dispenser comprising a divider that is positioned in the housing between a first interior volume and a second interior volume;

transferring a first portion of a second liquid from a second interior volume of the housing into the first interior volume to form a mixture via a one-way valve in the divider, wherein the transferring step comprises inverting the dispenser and opening the valve by squeezing the housing to allow flow therepast;

dispensing at least a portion of the mixture from the first interior volume through a first opening in the housing to an exterior of the housing, wherein the housing is configured to dispense a second portion of the second liquid from the second interior volume of the housing through a second opening in the housing to the exterior of the housing.

11. The method of claim 10, further comprising comparing a color of the mixture to a visual indicator on the housing to determine a concentration of the second liquid in the mixture.

12. The method of claim 11, further comprising adding an additional amount of the first liquid into the first interior volume when the color of the mixture is a darker shade than the visual indicator.

13. The method of claim 11, further comprising transferring an additional portion of the second liquid from the second interior volume into the first interior volume when the color of the mixture is a lighter shade than the visual indicator.

* * * * *